US012686959B2

(12) United States Patent
Wenzel

(10) Patent No.: US 12,686,959 B2
(45) Date of Patent: Jul. 21, 2026

(54) SEWING HEAD

(71) Applicant: INTEVA PRODUCTS, LLC, Troy, MI (US)

(72) Inventor: Edward J. Wenzel, Troy, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 0 days.

(21) Appl. No.: 19/212,367

(22) Filed: May 19, 2025

(65) Prior Publication Data

US 2025/0354311 A1 Nov. 20, 2025

Related U.S. Application Data

(60) Provisional application No. 63/649,149, filed on May 17, 2024.

(51) Int. Cl.
*D05B 3/12* (2006.01)

(52) U.S. Cl.
CPC ..... *D05B 3/12* (2013.01); *D05D 2303/20* (2013.01); *D05D 2305/60* (2013.01)

(58) Field of Classification Search
CPC . D05B 3/12; D05B 3/00; D05B 23/00; D04H 1/52; B29C 65/62; B29C 66/474; B29D 99/0003; B29D 99/0014
(Continued)

(56) References Cited

U.S. PATENT DOCUMENTS 4,331,495 A * 5/1982 Lackman ..... B32B 7/06 112/440
4,331,723 A * 5/1982 Hamm ..... B32B 5/28 428/113

(Continued)

FOREIGN PATENT DOCUMENTS

CN 102933759 A 2/2013
EP 1479809 A1 11/2004

(Continued)

OTHER PUBLICATIONS

International Search Report for International Application No. PCT/US2025/025396; Mailing date, Aug. 5, 2025, 3 pages.

(Continued)

*Primary Examiner* — Danny Worrell
(74) *Attorney, Agent, or Firm* — CANTOR COLBURN LLP

(57) ABSTRACT

A composite sewn part for use in a subsequent curing process, including: a first composite laminate; at least one stringer secured to the first composite laminate by stitches, the at least one stringer including a first stringer portion comprising a composite laminate and a second stringer portion comprising a composite laminate, which are sewn together to provide the at least one stringer, the first stringer portion having a flange portion that is sewn to the first composite laminate and a web that extends upwardly from the flange portion and the second stringer portion having a flange portion that is sewn to the first composite laminate and a web that extends upwardly from the flange portion of the second stringer portion; and a polymer reinforcement located between the first stringer portion and the second stringer portion or between the first composite laminate and the first stringer portion and the second stringer portion.

18 Claims, 14 Drawing Sheets

(58) Field of Classification Search
USPC ..... 112/415, 400, 401, 402, 422, 423, 426, 112/475.01, 475.06, 1
See application file for complete search history.

(56) References Cited

U.S. PATENT DOCUMENTS

| | | | | |
|---|---|---|---|---|
| 5,827,383 | A * | 10/1998 | Campbell | B29C 70/24 156/303.1 |
| 6,357,371 | B1 | 3/2002 | Moll et al. | |
| 7,997,534 | B2 * | 8/2011 | Eberth | B29C 66/532 244/123.4 |
| 8,978,565 | B2 | 3/2015 | Asao et al. | |
| 9,637,213 | B2 * | 5/2017 | Joern | B64C 1/06 |
| 2008/0210824 | A1 | 9/2008 | Eberth | |
| 2009/0320292 | A1 | 12/2009 | Brennan et al. | |
| 2010/0129589 | A1 | 5/2010 | Senibi et al. | |
| 2011/0143085 | A1 * | 6/2011 | Blot | D04H 1/4242 428/102 |
| 2011/0287208 | A1 * | 11/2011 | Velicki | B64C 1/061 156/60 |
| 2020/0148326 | A1 * | 5/2020 | Linton | B64C 3/185 |
| 2020/0156759 | A1 * | 5/2020 | Linton | B64C 3/182 |
| 2022/0290346 | A1 | 9/2022 | Takamura | |

FOREIGN PATENT DOCUMENTS

| | | | |
|---|---|---|---|
| JP | 2009172061 | A | 8/2009 |
| WO | 2015158865 | A1 | 10/2015 |
| WO | WO-2025222138 | A1 * | 10/2025 |

OTHER PUBLICATIONS

Written Opinion for International Application No. PCT/US2025/025396; Mailing date, Aug. 5, 2025, 4 pages.
International Search Report for International Application No. PCT/US2025/030048; Mailing date, Sep. 2, 2025, 4 pages.
Written Opinion of the International Searching Authority for International Application No. PCT/US2025/030048; Mailing date, Sep. 2, 2025, 4 pages.

* cited by examiner

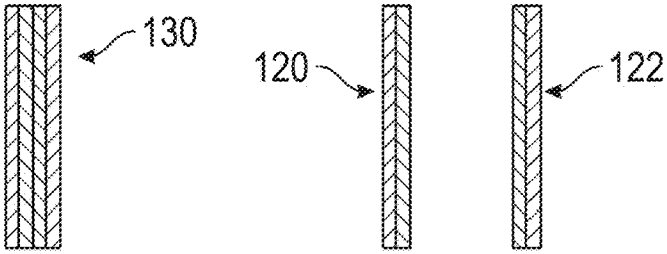
FIG. 12A
FIG. 12B
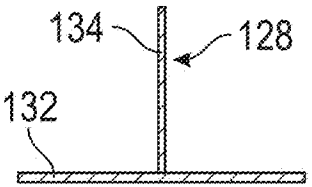
FIG. 12C
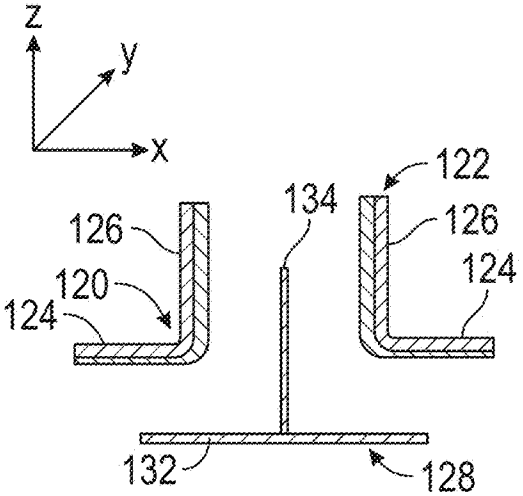
FIG. 12D
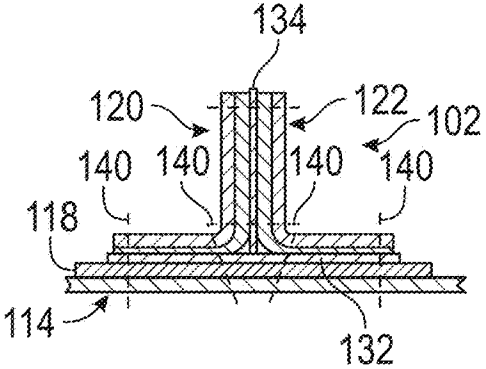
FIG. 12G
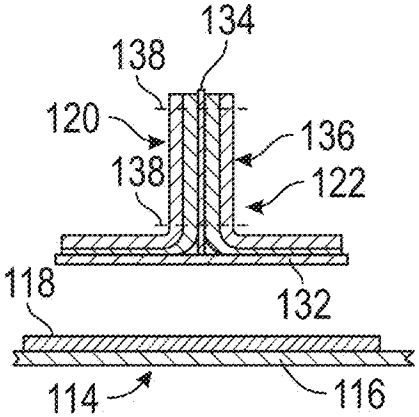
FIG. 12F
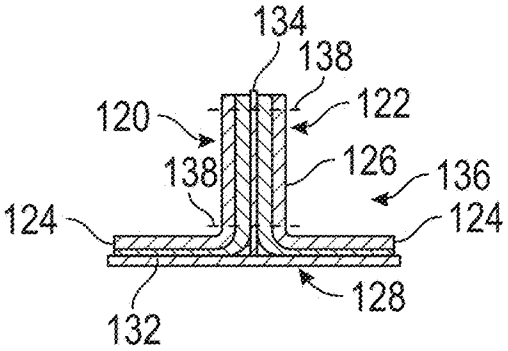
FIG. 12E

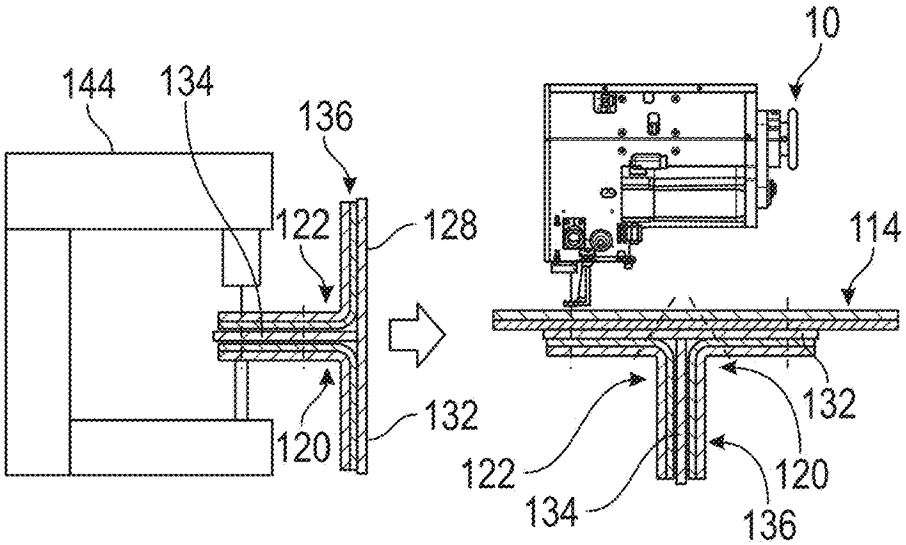
FIG. 14D
FIG. 14C
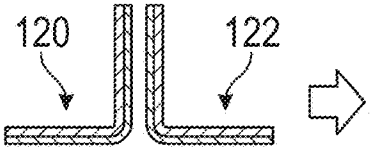
FIG. 14B
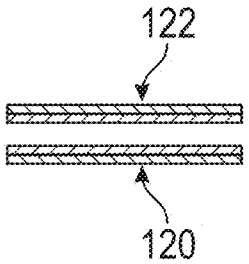
FIG. 14A

SEWING HEAD

CROSS REFERENCE TO RELATED APPLICATIONS

This application claims the benefit of U.S. Provisional Application No. 63/649,149 filed on May 17, 2024 the entire contents of which are incorporated herein by reference thereto.

TECHNICAL FIELD

Exemplary embodiments of the present disclosure pertains to the art of composite sewn parts.

BACKGROUND

Composite materials may be sewn together prior to the sewn composite material being resin infused to create a final, cured composite part. The composite materials are flexible prior to the curing step. Thus, it is desirable to provide support to the composite materials during the stitching process which occurs prior to the curing process.

BRIEF DESCRIPTION

Disclosed is a composite sewn part for use in a subsequent curing process, including: a first composite laminate; at least one stringer secured to the first composite laminate by stitches, the at least one stringer including a first stringer portion comprising a composite laminate and a second stringer portion comprising a composite laminate, which are sewn together to provide the at least one stringer, the first stringer portion having a flange portion that is sewn to the first composite laminate and a web that extends upwardly from the flange portion and the second stringer portion having a flange portion that is sewn to the first composite laminate and a web that extends upwardly from the flange portion of the second stringer portion; and a polymer reinforcement located between the first stringer portion and the second stringer portion or between the first composite laminate and the first stringer portion and the second stringer portion.

In addition to one or more of the features described above, or as an alternative to any of the foregoing embodiments, the flange portion and the web of the first stringer portion are integrally formed with each other to provide a single unitary structure and wherein the flange portion and the web of the second stringer portion are integrally formed with each other to provide a single unitary structure.

In addition to one or more of the features described above, or as an alternative to any of the foregoing embodiments, the first composite laminate, the first stringer portion and the second stringer portion are formed from Non-Crimp Fabrics (NCF) which consist of unidirectional laminate plies.

In addition to one or more of the features described above, or as an alternative to any of the foregoing embodiments, the first composite laminate, the first stringer portion and the second stringer portion are formed from Non-Crimp Fabrics (NCF) which include unidirectional laminate plies.

In addition to one or more of the features described above, or as an alternative to any of the foregoing embodiments, materials and composition and layers of the first stringer portion and the second stringer portion are the same as the first composite laminate.

In addition to one or more of the features described above, or as an alternative to any of the foregoing embodiments, the polymer reinforcement is formed by an extrusion process.

In addition to one or more of the features described above, or as an alternative to any of the foregoing embodiments, the polymer reinforcement includes a horizontal portion and an upwardly extending vertical portion that extends from a portion of the horizontal portion.

In addition to one or more of the features described above, or as an alternative to any of the foregoing embodiments, the first stringer portion and the second stringer portion contain an equal amount of laminate layers.

In addition to one or more of the features described above, or as an alternative to any of the foregoing embodiments, the polymer reinforcement includes a horizontal portion located between the flange portion of the first stringer portion and the flange portion of the second stringer portion and the polymer reinforcement includes an upwardly extending vertical portion that extends from a portion of the horizontal portion, the upwardly extending vertical portion being located between the web of the first stringer portion and the web of the second stringer portion.

In addition to one or more of the features described above, or as an alternative to any of the foregoing embodiments, the polymer reinforcement is only located between the first stringer portion and the second stringer portion.

In addition to one or more of the features described above, or as an alternative to any of the foregoing embodiments, the polymer reinforcement is only located between first composite laminate and the first stringer portion and the second stringer portion.

In addition to one or more of the features described above, or as an alternative to any of the foregoing embodiments, the polymer reinforcement is located between the first stringer portion and the second stringer portion and the polymer reinforcement is located between first composite laminate and the first stringer portion and the second stringer portion.

In addition to one or more of the features described above, or as an alternative to any of the foregoing embodiments, the polymer reinforcement includes a horizontal portion located between the flange portion of the first stringer portion and the flange portion of the second stringer portion and the polymer reinforcement includes an upwardly extending vertical portion that extends from a portion of the horizontal portion, the upwardly extending vertical portion being located between the web of the first stringer portion and the web of the second stringer portion and the polymer reinforcement includes a polymer reinforcing rod at an end of the upwardly extending vertical portion of the polymer reinforcement.

In addition to one or more of the features described above, or as an alternative to any of the foregoing embodiments, the first stringer portion and the second stringer portion are part of a single stringer portion which extends over the polymer reinforcing rod.

In addition to one or more of the features described above, or as an alternative to any of the foregoing embodiments, the polymer reinforcement is formed by an extrusion process.

Also disclosed is a method for providing a composite sewn part for use in a subsequent curing process, including: locating a polymer reinforcement between a first stringer portion comprising a composite laminate and a second stringer portion comprising a composite laminate or locating a polymer reinforcement between a first composite laminate and a first stringer portion and a second stringer portion; stitching the first stringer portion to the second stringer portion to provide at least one stringer; stitching the first stringer portion to the first composite laminate; stitching the second stringer portion to the first composite laminate; and wherein during the at least one of the stitching steps the stitches pass through the polymer reinforcement.

In addition to one or more of the features described above, or as an alternative to any of the foregoing embodiments, the first stringer portion has a flange portion that is sewn to the first composite laminate and a web that extends upwardly from the flange portion and the second stringer portion having a flange portion that is sewn to the first composite laminate and a web that extends upwardly from the flange portion of the second stringer portion, and the web of the first stringer portion is sewn to the web of the second stringer portion.

In addition to one or more of the features described above, or as an alternative to any of the foregoing embodiments, the flange portion and the web of the first stringer portion are integrally formed with each other to provide a single unitary structure and wherein the flange portion and the web of the second stringer portion are integrally formed with each other to provide a single unitary structure.

In addition to one or more of the features described above, or as an alternative to any of the foregoing embodiments, the first composite laminate, the first stringer portion and the second stringer portion are formed from Non-Crimp Fabrics (NCF) which consist of unidirectional laminate plies.

BRIEF DESCRIPTION OF THE DRAWINGS

The following descriptions should not be considered limiting in any way. With reference to the accompanying drawings, like elements are numbered alike:

FIGS. 12A-12G illustrate a laminate constriction process in accordance with the present disclosure;

FIGS. 14A-14D illustrate a laminate constriction process in accordance with the present disclosure;

DETAILED DESCRIPTION

A detailed description of one or more embodiments of the disclosed apparatus and method are presented herein by way of exemplification and not limitation with reference to the Figures.

Overview

The present disclosure is directed to a single-sided sewing head for the purpose of stitching together layers of a dry non-crimped carbon fiber multiaxial laminate to enhance z-axis (through thickness) strength as well as enhance the resistance to delamination of composite laminates The sewing head is also used to attached stringers, frame stacks, stringer and frame straps, tapes and other reinforcements to the skin of a composite structure.

The sewing head can be mounted to a robot to enable the head to be articulated over the surface of a 3D composite structure.

Current State-of-the-Art

A single sided sewing head using two needles and a single thread.

The thread is fed through composite laminate using a needle angled 45 degrees (feed needle) to the composite laminate surface.

While the thread feed needle is fully extended through the composite laminate, the thread from the feed needle is hooked by a second needle (catcher needle) that penetrates the composite laminate 90 degrees to the A-surface or show surface of the composite laminate.

The catcher needle then carries the thread through the composite laminate. Once pulled completely through, a thread picker engages and retains the thread, allowing the catcher needle to move downward through the loop for the next cycle before releasing the thread loop.

Figure 1:
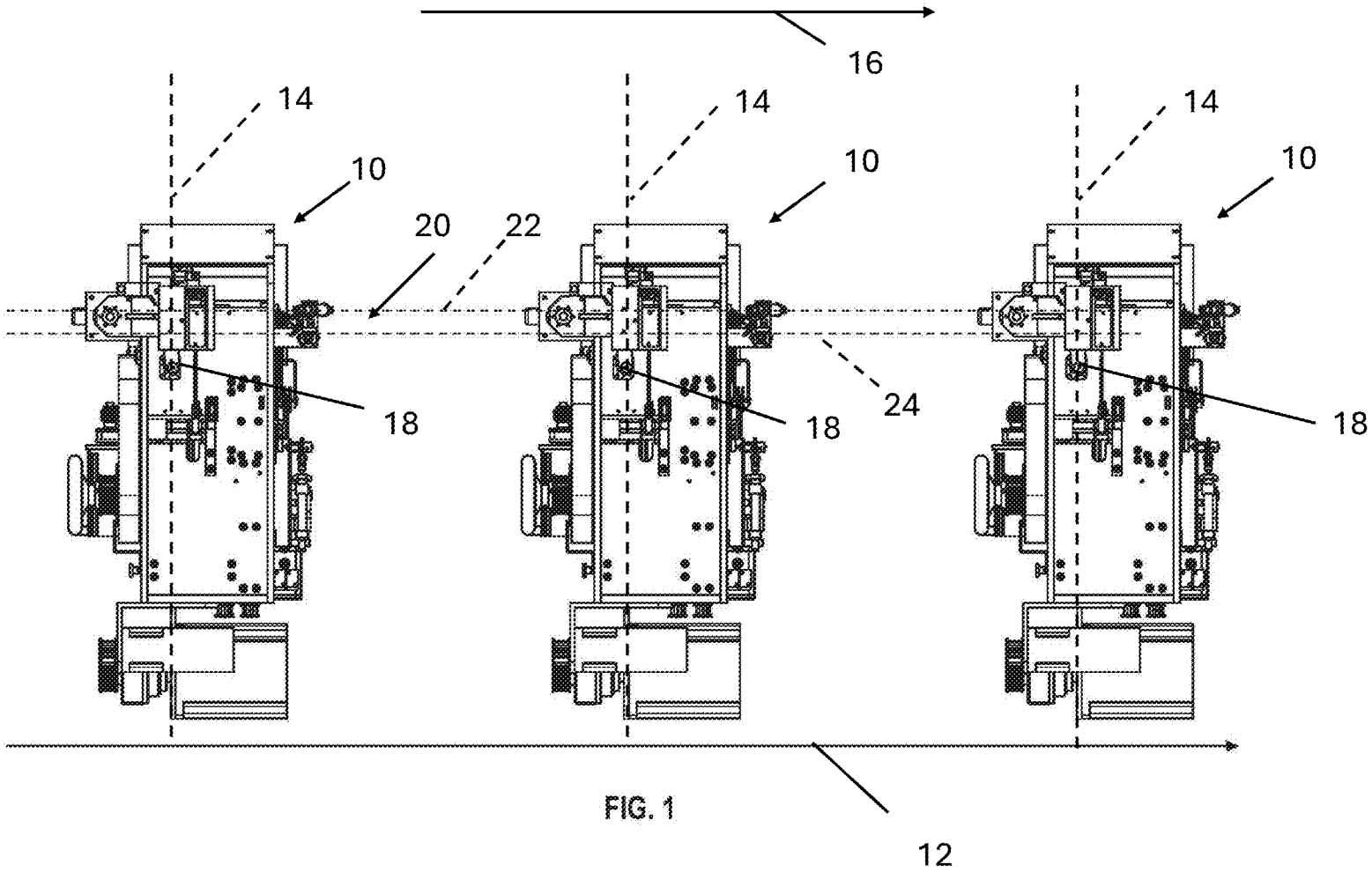
FIG. 1 illustrates a conventional machine feed.

Referring now to FIG. 1 movement of a sewing head 10 in the direction of arrow 12 is illustrated. In FIG. 1, the movement of the sewing head 10 in the direction of arrow 12 is illustrated by the three images of the sewing head 10. The direction of arrow 12 may be referred to as the sewing head path. Here the needle plane of sewing head 10 is illustrated by the dashed lines 14. In this configuration, the needle plane 14 is arranged at a 90 degree angle with respect to the sewing head path 12 or stitch direction illustrated by arrow 16. The sewing head 10 has a thread feed needle and a thread catcher needle contained within the needle plane that is arranged 90 degrees with respect to the stitch path. Movement of the needle plane containing the thread feed needle and the thread catcher needle is facilitated by a needle bar transport 18 arranged to move the needle plane parallel to the stitch path.

The configuration of the thread feed needle and the thread catcher needle require a channel 20 defined by dashed lines 22 and 24. The passage or channel 20 is located in a fixture that supports a composite laminate that is being stitched by the sewing head 10. The channel 20 needs to be wide enough to provide clearance for the sewing needle(s) (the thread feed needle and the thread catcher needle) upon penetration through the backside of the composite laminate. The large width of the channel that is cut into the fixture along the sewing path can allow the laminate material to be pushed into the channel during sewing, which is undesirable. Current methods used to prevent material displacement into the fixture channel 20 consist of adding a veil of material between the B-side of the composite laminate and the top side of the sewing fixture to provide support to the laminate. The time required to install the veil between each part sewing cycle is excessive and leads to a significant increase in the overall processing time to produce a finished composite product. As such, the width of the channel 20 illustrated in FIG. 1 is too wide.

Figure 2:
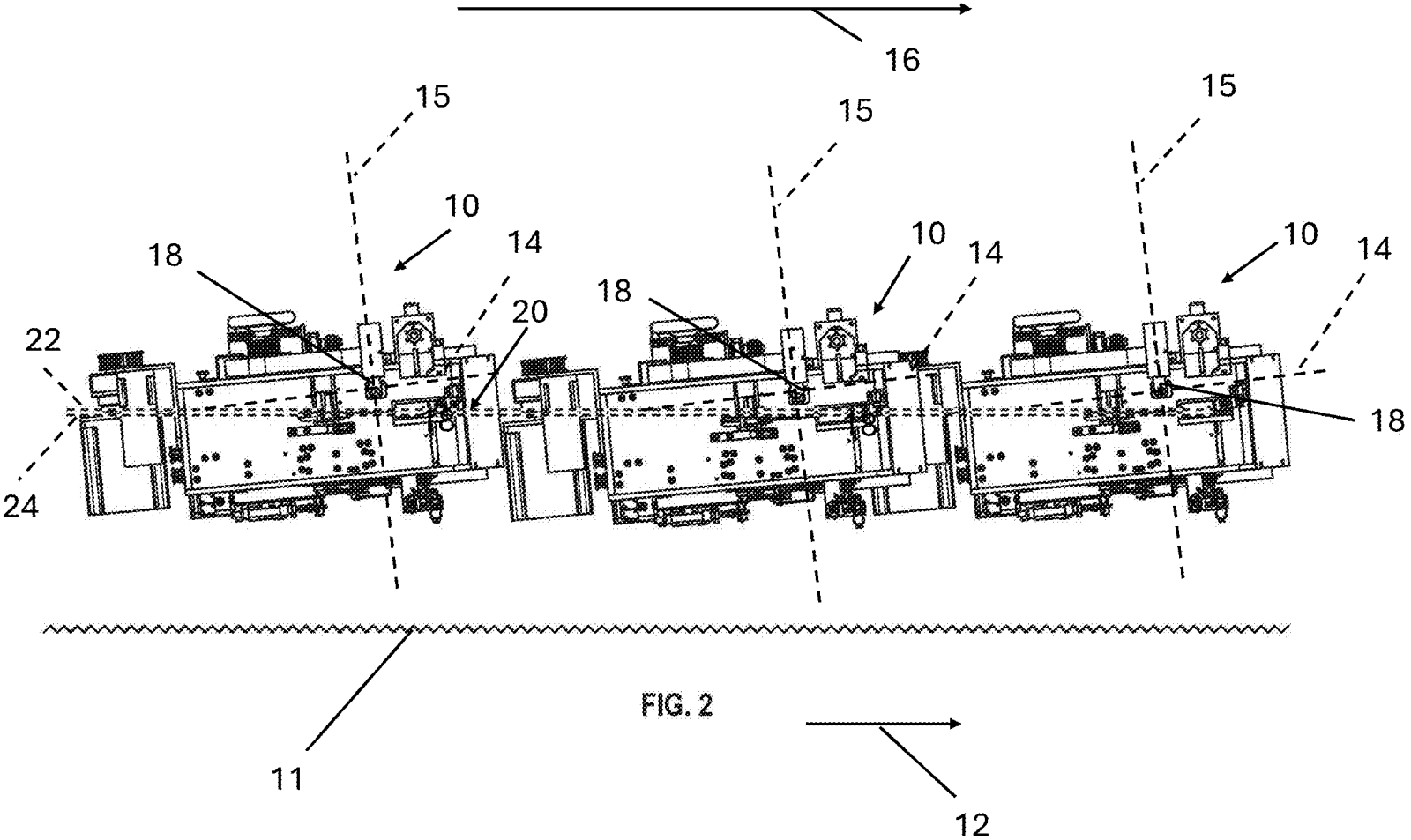
FIG. 2 illustrates a sideslip machine feed.

Referring now to FIG. 2, a sewing head 10 of a sideslip machine is illustrated. Again movement of the sewing head 10 in the direction of the sewing head path 12 is illustrated. In FIG. 2, the movement of the sewing head 10 in the direction of arrow 12 is illustrated by the three images of the sewing head 10. The direction of arrow 12 may be referred to as the sewing head path. Here the needle plane of sewing head 10 illustrated by the dashed lines 14 is offset from the sewing head path 12 or stitch direction illustrated by arrow 16 by about 5 degrees. However and in this configuration, the needle bar transport 18 is arranged approximately 85 degrees with respect to the stitch path 16. See dashed lines 15.

The sewing head 10 illustrated in FIG. 2 has a thread feed needle and a thread catcher needle that are arranged about 85 degrees with respect to the stitch path. Movement of the thread feed needle and the thread catcher needle are facilitated by a needle bar transport 18 approximately 85 degrees with respect to the stitch path 16.

The configuration of the thread feed needle and the thread catcher needle of the head 10 of FIG. 2 requires a channel 20 defined by dashed lines 22 and 24. While this channel 20 is smaller than the channel 20 of FIG. 1, the robot must move the sewing head in a zig zag pattern as illustrated by line 11 in FIG. 2 to ensure that the robot path movement is parallel to the needle plane transport direction. As such, the sew path programming is complex and the sewing speed is slow as compared to what is desired.

Limitations with Current State-of-the-Art (FIGS. 1 and 2)

There is a lack of power to drive the sewing needle(s), thread feed needle and the thread catcher needle through the composite.

Breakage of sewing needles.

The catcher needle hook tends to catch on the composite laminate as it is being withdrawn from the laminate. Damage to the composite laminate fibers can lead to reduced performance under load as well as stitching irregularities.

The thread picker can fray the thread during removal from the catcher needle.

It is also difficult to achieve consistent thread tension across stitching path.

As mentioned above, the passage or channel 20 required along the sewing path 16 in a fixture that supports the composite laminate needs to be wide enough to provide clearance for the sewing needle(s) (the thread feed needle and the thread catcher needle) upon penetration through the backside of the composite laminate. The large width of the channel that is cut into the fixture along the sewing path can allow the laminate material to be pushed into the channel during sewing. Current methods used to prevent material displacement into the fixture channel consist of adding a veil of material between the B-side of the composite laminate and the top side of the sewing fixture to provide support to the laminate. The time required to install the veil between each part sewing cycle is excessive and leads to a significant increase in the overall processing time to produce a finished composite product.

Improvements to Current State-of-the-Art

Figure 3:
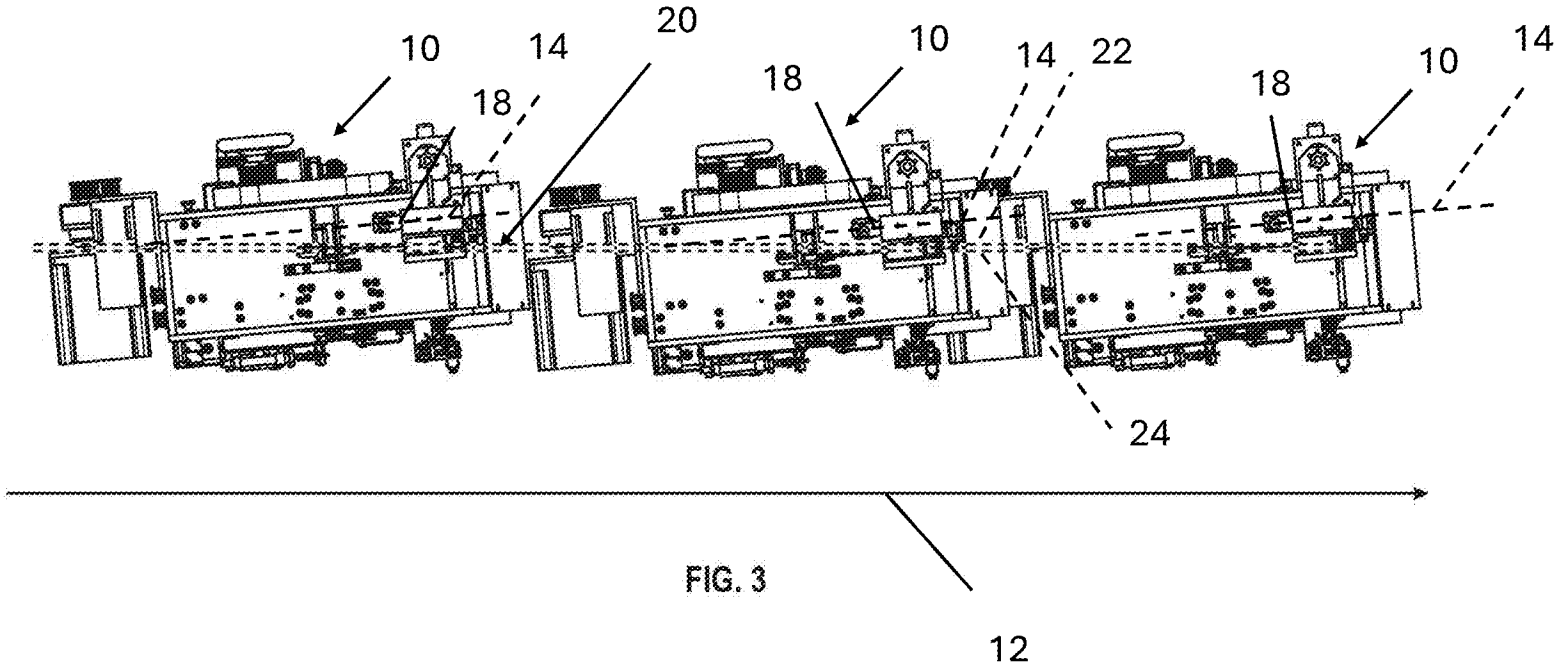
FIG. 3 illustrates a machine feed and sewing head in accordance with the present disclosure.
Figure 3A:
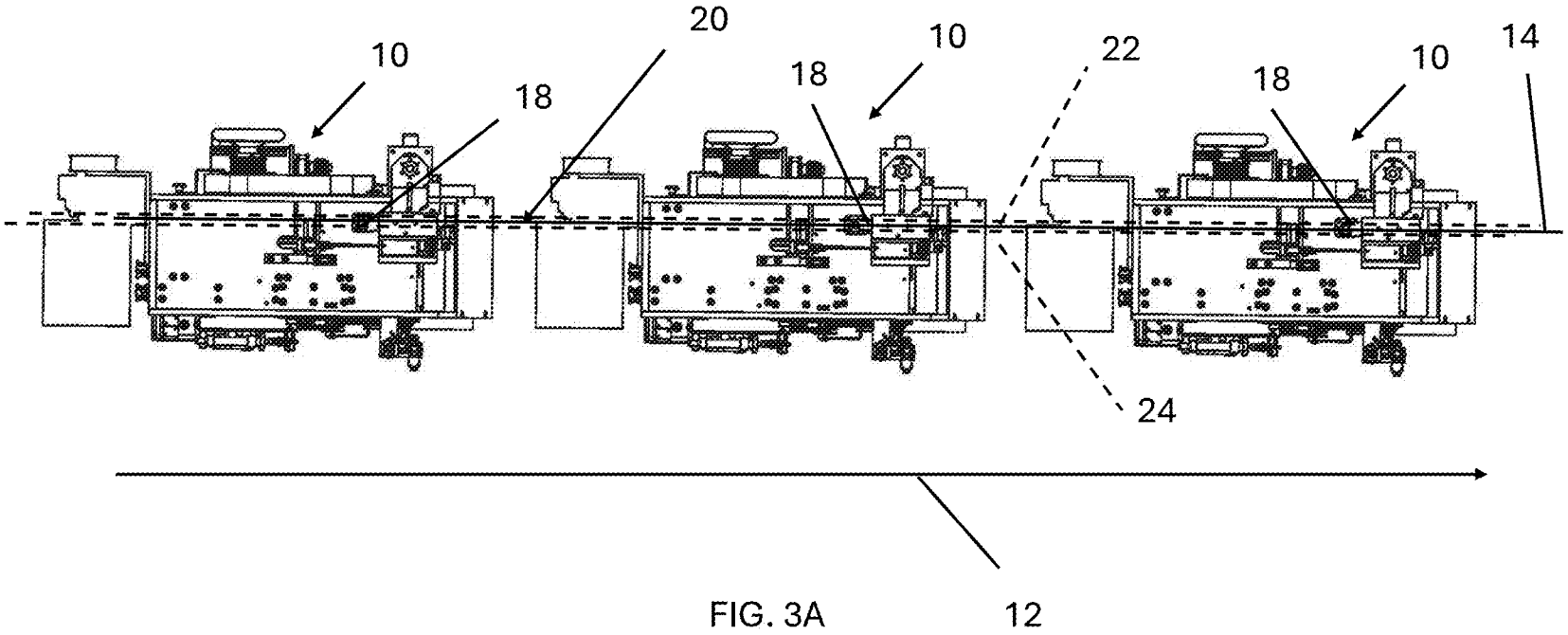
FIG. 3A illustrates a machine feed and sewing head in accordance with the present disclosure.

Referring now to at least FIGS. 3, 3A, a sewing head or composite sewing head and method of the present disclosure is illustrated. Here the needle bar transport is parallel to the needle plane instead of perpendicular (e.g., 90 degrees) to the needle plane as illustrated in FIGS. 1 and 2. With the needle bar transport arranged parallel to the needle plane, and the needle plane parallel or nearly parallel (5 to 15 degrees) to the stitch path, the width of the of needle projection through the B-side of the laminate stack is reduced and thus the width of the channel 20 on the laminate support fixture can be reduced. As such the width of the channel 20 that needs to be machined into a top side surface of the laminate support fixture is minimized. This will also enable increased sewing speed.

As used herein "needle bar transport" refers to a mechanism in the sewing head 10 for facilitating reciprocal movement of at least the thread feed needle and the thread catcher needle in order to stitch a thread through a part surface.

In addition and in another embodiment of the present disclosure, the catcher needle is encapsulated by a sleeve during penetration through the composite laminate. The sleeve will cover the hook portion of the catcher needle during needle passage through the laminate and prevent the hook from engaging with the laminate fibers upon needle retraction. The sleeve is movably secured to the catcher needle to allow for a thread picker to engage and retain the thread during operation but cover the hook portion of the catcher needle during needle passage through the laminate and prevent the hook from engaging with the laminate fibers upon needle retraction.

The angle between the catcher and feed needles is adjustable so that the sewing head 10 can be setup to manage a variety of composite material thicknesses and compositions.

The sewing head 10 can also provide real time compensation for variations in the material thickness during sewing. This is provided by an ultrasonic sensor or other types of sensors or sensor means for detecting composite laminate thickness and will be placed at a defined distance ahead of the needle bar plane. This sensor will detect variation in laminate thickness and provide feedback to the sewing head controller in real time. Prior to the sewing head reaching the point of thickness variation, the position of the pressor foot position and sewing head normal to the laminate surface will be adjusted automatically to ensure a consistent depth of needle penetration along the entire stitch path. Maintaining a consistent depth of needle penetration beneath the B-side of the laminate will ensure that no stitching irregularity occurs.

Figure 4:
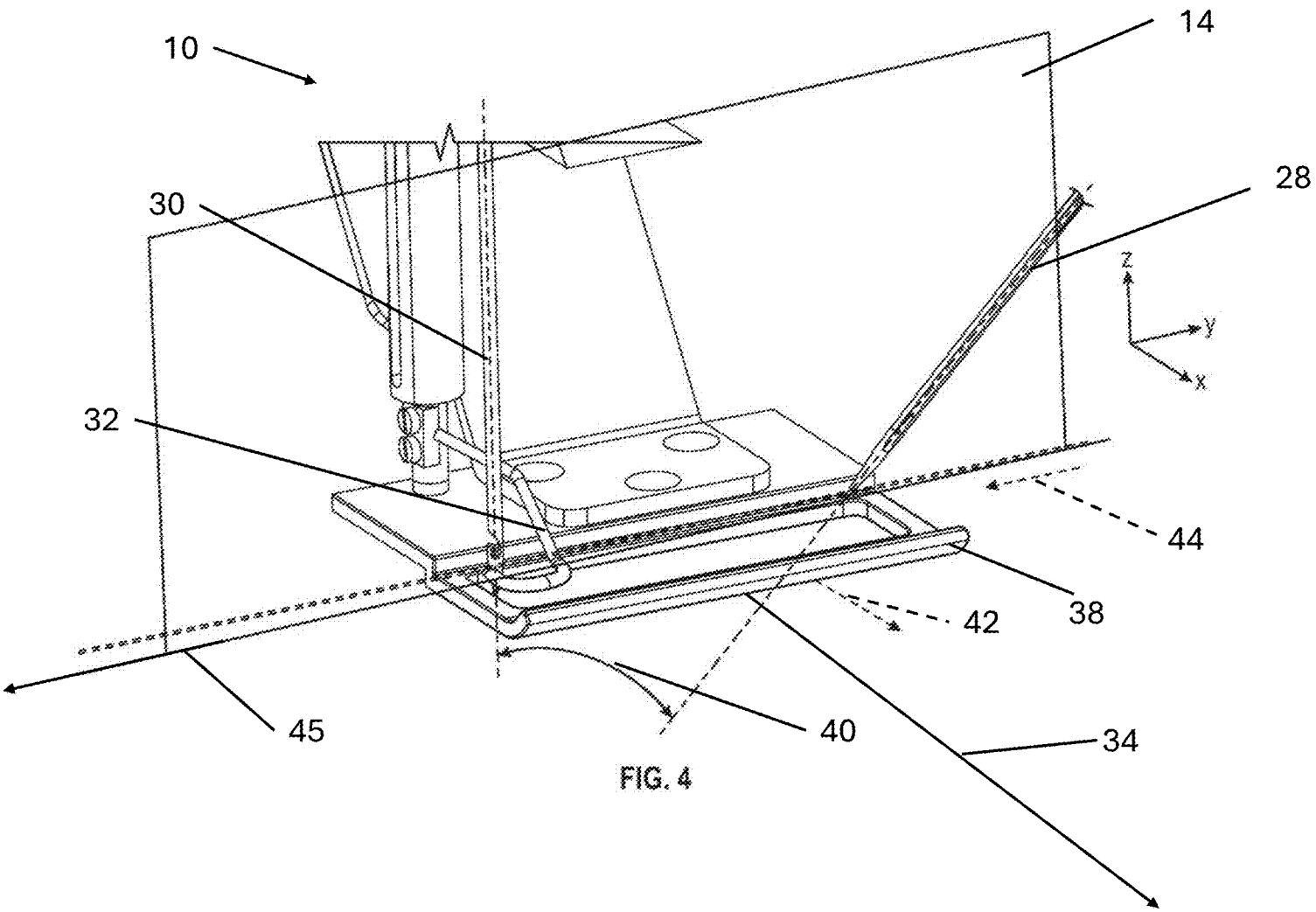
FIG. 4 is perspective view of a portion of a composite sewing head in accordance with the present disclosure.

Referring now to FIG. 4, portions of the sewing head 10 is illustrated. Also, illustrated is the needle plane 14. Also illustrated is a thread feed needle 28, a thread catcher needle 30, a thread picker 32, an existing stitch path 34, an existing needle bar transport direction 42, a presser foot 38, an angle 40 between the thread feed needle 28 and the thread catcher needle 30, a proposed needle bar transport direction illustrated by arrow 44, a proposed stitch path illustrated by arrow 45.

Figure 5:
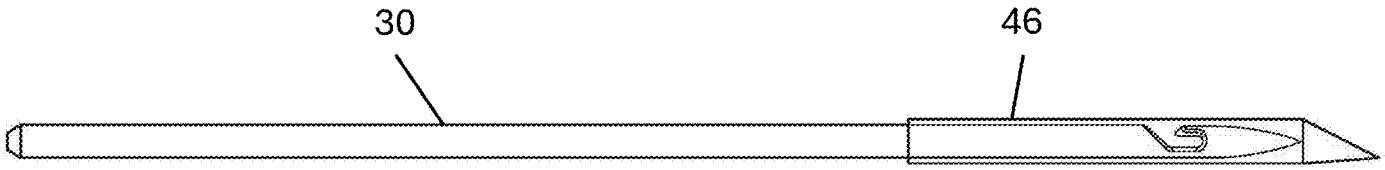
FIG. 5 is a view of a catcher needle and sleeve in accordance with the present disclosure.
Figure 6:
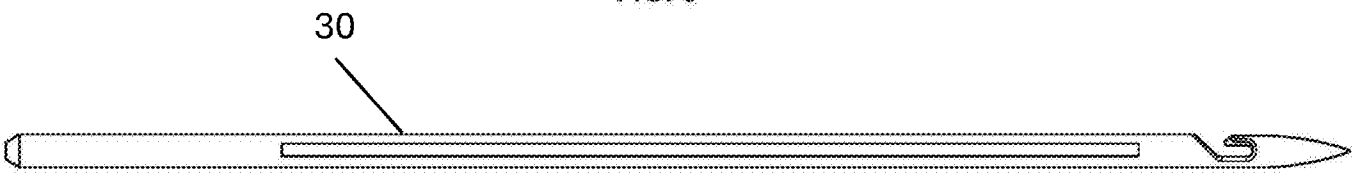
FIG. 6 is a view of a catcher needle in accordance with the present disclosure.
Figure 7:
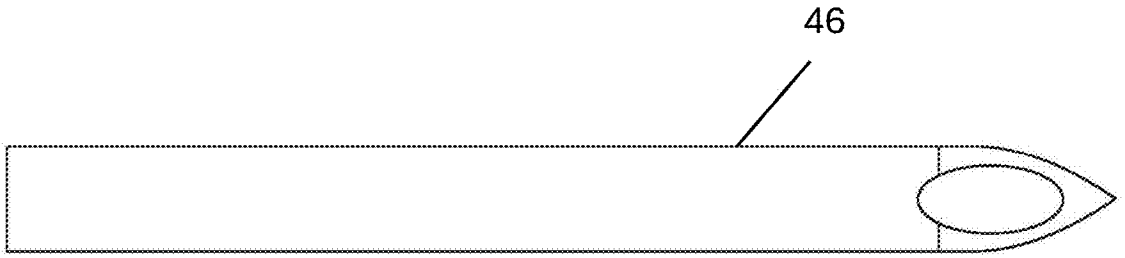
FIG. 7 is a view of a sleeve for a catcher needle in accordance with the present disclosure.

Referring now to at least FIGS. 5-7, a catcher needle 30 and a sleeve 46 for the catcher needle 30 is illustrated. FIG. 5 illustrates the catcher needle 30 and sleeve 46 while FIG. 6 illustrates the catcher needle 30 and FIG. 7 illustrated the needle sleeve 46. In one non-limiting embodiment, one non-limiting outer diameter of the catcher needle 30 is approximately 2.38 mm and one corresponding non-limiting outer diameter of the needle sleeve 46 is approximately 2.9 mm. It is, of course, understood that in accordance with the present disclosure the outer diameter of the catcher needle 30 and the outer diameter of the needle sleeve 46 may be greater or less than the aforementioned dimensions of 2.38 mm and 2.9 mm.

Figure 8:
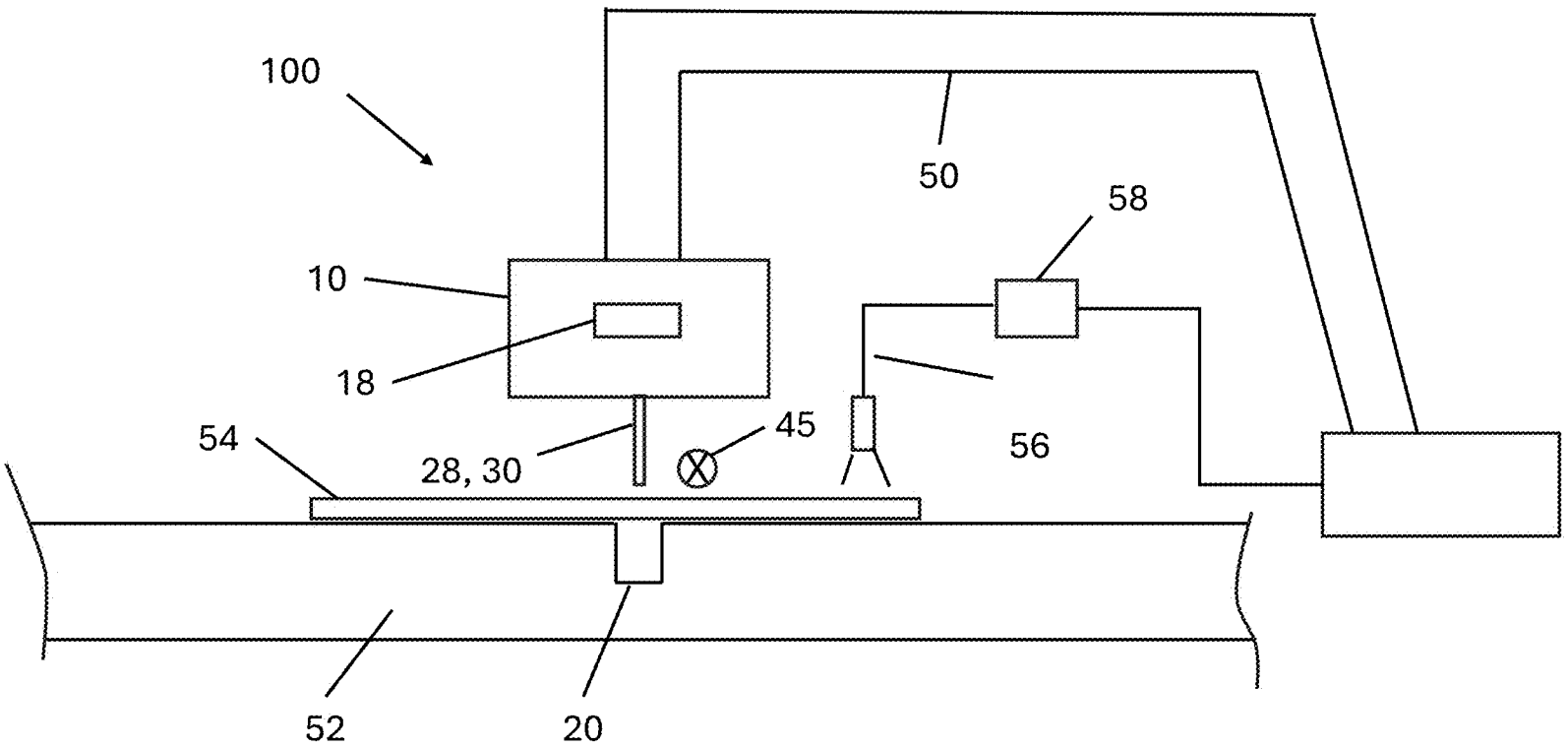
FIG. 8 is a view of a sewing cell in accordance with the present disclosure.

Referring now to at least FIG. 8, a sewing assembly 100 is illustrated in accordance with the present disclosure. The sewing assembly 100 includes the sewing head 10 which is secured to a robot 50. The stitch path 45 is normal to the plane of FIG. 8. The needle bar transport 18 is illustrated schematically by box 18 and the thread feed needle 28 and the thread catcher needle 30 are illustrated by the box labeled 28, 30. Also shown is a fixture 52 with the aforementioned channel 20. A composite laminate or laminates 54 for being sewn together are also shown. Also shown is a sensor 56 that may be secured to the sewing head 10 for detecting a thickness of the composite laminate 54 that is places at a defined distance ahead and inline with the needle bar plane. This sensor 56 will detect variations in the laminate 54 thickness and provide feedback to a sewing head controller 58 in real time. As such, and prior to the sewing head 10 reaching the point of thickness variation, both the position of the pressor foot 38 normal to the laminate 54 surface and the sewing head 10 will be adjusted automatically to ensure a consistent depth of needle penetration along the entire stitch path. Maintaining a consistent depth of needle penetration beneath the B-side of the laminate will ensure that no stitching irregularity occurs.

In an embodiment, the controller 58 may include memory to store instructions that are executed by one or more processors. The executable instructions may be stored or organized in any manner and at any level of abstraction, such as in connection with a controlling and/or monitoring operation of the robot 50 and the sewing head 10. The one or more processors can be any type of central processing unit (CPU), including a general purpose processor, a digital signal processor (DSP), a microcontroller, an application specific integrated circuit (ASIC), a field programmable gate array (FPGA), or the like. Also, in embodiments, the memory may include random access memory (RAM), read only memory (ROM), or other electronic, optical, magnetic, or any other computer readable medium onto which is stored data and control algorithms in a non-transitory form.

Figure 9:
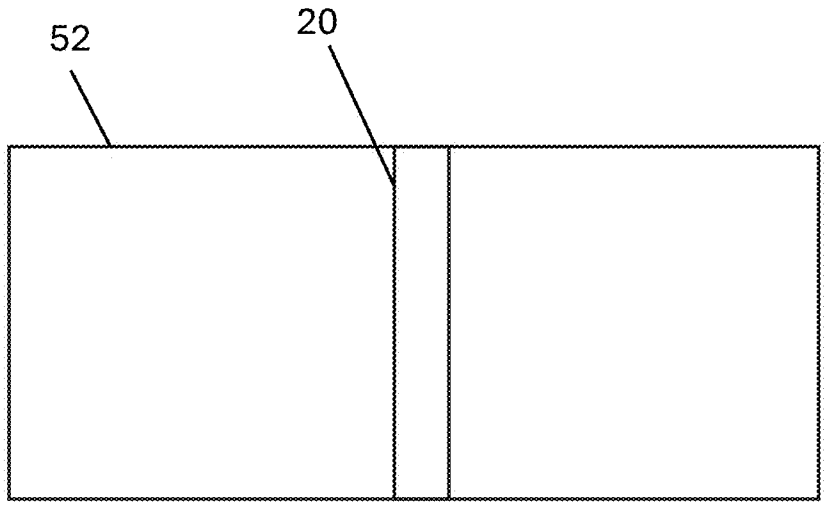
FIG. 9 is a top view of a sewing fixture in accordance with the present disclosure.

FIG. 9 is a top plan view of a fixture 52 with a channel 20.

Referring now to at least FIGS. 10A, 10B, 11A and 11B, the sewing head 10 can be setup to provide a single stitch path or multiple stitch paths. FIGS. 10A, 10B, 11A and 11B illustrate a portion of composite laminates 54 being sewn together to provide a composite sewn part 102 for use in a subsequent curing process. Note, only a portion of the composite sewn part 102 is illustrated in the attached FIGS.

Figure 10B:
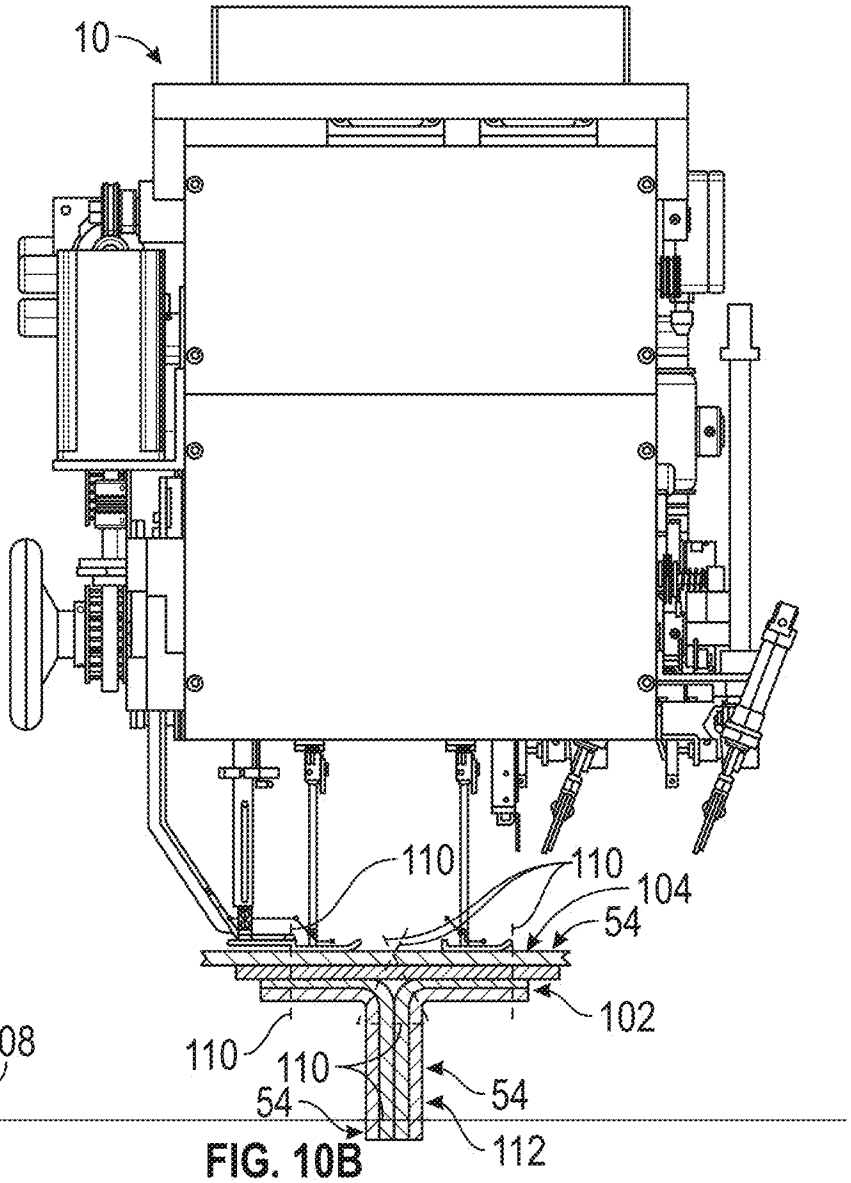
FIG. 10B is a view of a composite sewing head sewing composite laminates together on an A-side or show side of a product with a dual stitch path/pass.
Figure 10A:
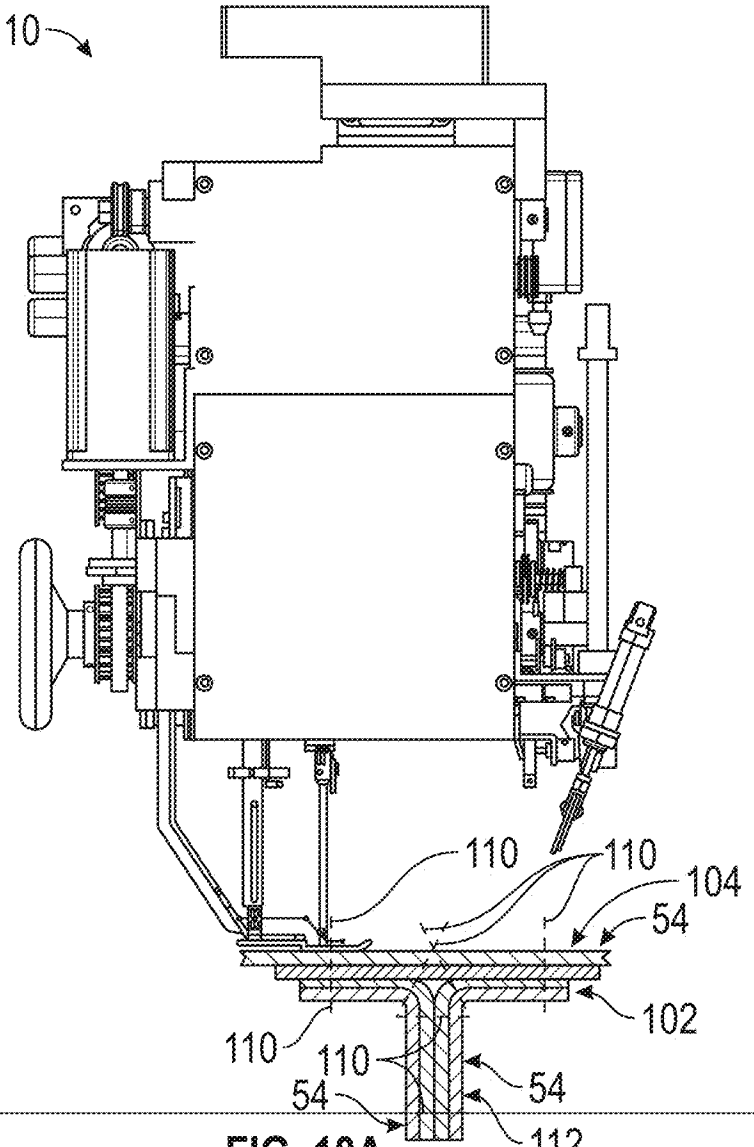
FIG. 10A is a view of a composite sewing head sewing composite laminates together on an A-side or show side of a product with a single stitch path/pass.

FIG. 10A is a view of the composite sewing head 10 sewing composite laminates together to provide the composite sewn part 102 on an A-side or show side 104 of composite sewn part 102 with a single stitch path/pass. FIG. 10B is a view of the composite sewing head 10 sewing composite laminates together to provide the composite sewn part 102 on the A-side or show side 104 of composite sewn part 102 with a dual stitch path/pass.

Figure 11B:
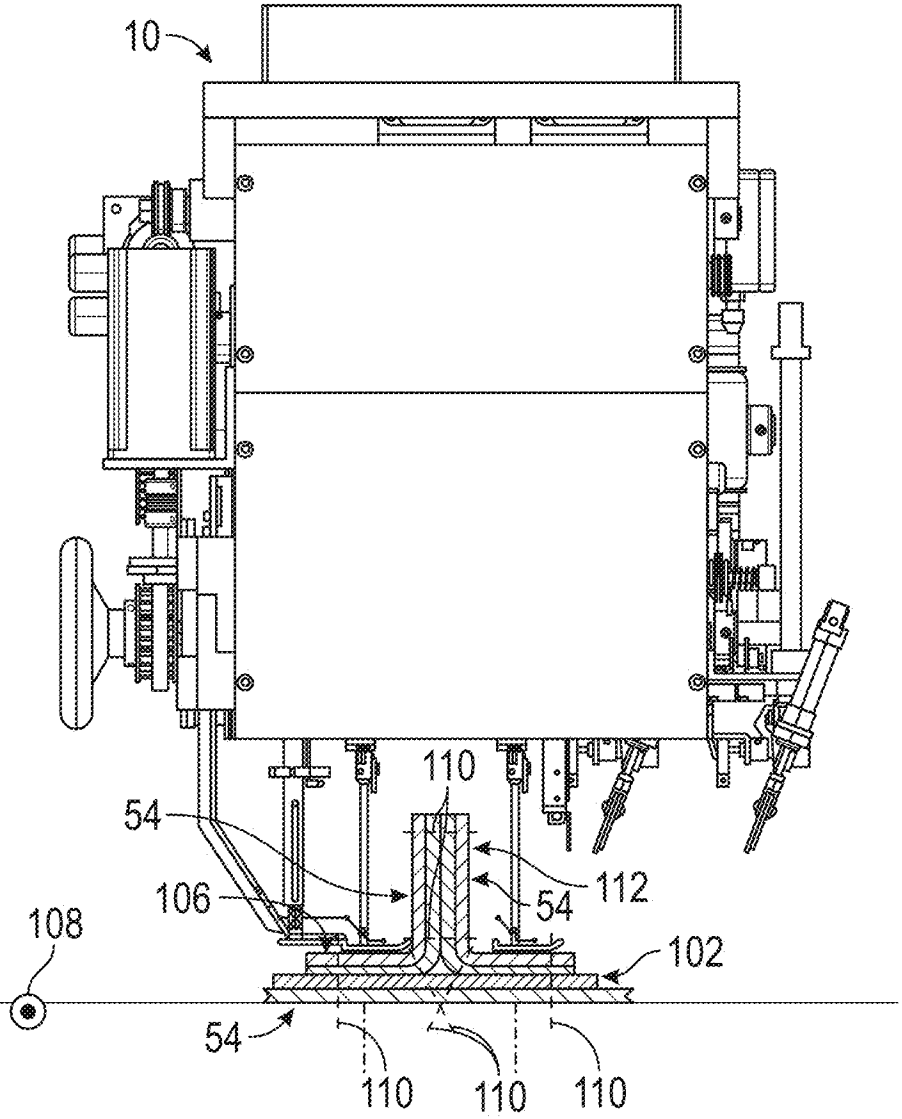
FIG. 11B is a view of a composite sewing head sewing composite laminates together on an B-side or non-show side of a product with a dual stitch path/pass.
Figure 11A:
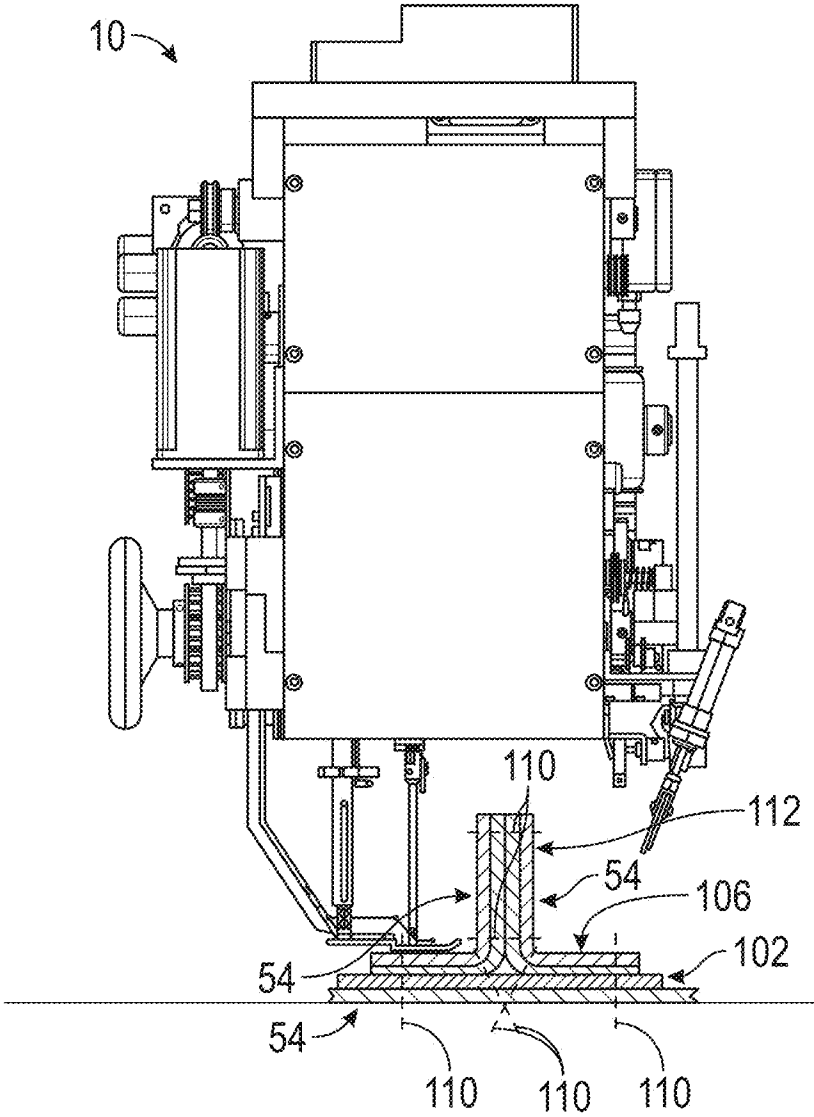
FIG. 11A is a view of a composite sewing head sewing composite laminates together on an B-side or non-show side of a product with a single stitch path/pass.

FIG. 11A is a view of a composite sewing head sewing 10 sewing composite laminates together to provide the composite sewn part 102 on a B-side or non-show side 106 of the composite sewn part 102 with a single stitch path/pass. FIG. 11B is a view of the composite sewing head 10 sewing composite laminates together on the B-side or non-show side 106 of the composite sewn part 102 with a dual stitch path/pass. A feed direction of the sewing of the composite sewn part 102 is illustrated by circle 108 which extends outwardly and into the FIGS. 10A-11B. The applied stitches of the composite sewing head 10 are shown by the dashed arrows/lines 110.

Utilization of two needle sets or dual stitching allows a stitch to be placed on both sides of a stringer 112 of the composite sewn part 102 at the same time instead of sequentially, which offers cycle time savings. This technique is applicable when stitching from either the A-side or B-side of the composite sewn part 102. Stitching from the B-side of the composite sewn part 102 also eliminates the need for a pocket in the tooling to accommodate the stringer webs (FIG. 13) and thus simplifies the tooling build as well as improves support for the stringer during stitching.

Referring now to at least FIGS. 12A-12G a laminate construction process in accordance with the present disclosure is illustrated. The composite sewn part 102 includes a first composite laminate or skin laminate 114 which provides the A-side or a show surface 116 and the B-side or non-show surface 118 of the composite sewn part 102, and a plurality of stringers 112, only one of which is shown, that is secured to the B-side or non-show surface 118 of the first composite laminate 114. At least FIGS. 12A-12G illustrate the securement of stringer 112 to the first composite laminate or skin laminate 114. Each one of the plurality of stringers 112 includes a first stringer portion 120 and a second stringer portion 122, which are sewn together to provide the stringer 112. Each first stringer portion 120 and each second stringer portion 122 have a flange portion 124 that is sewn to the first composite laminate 114 on the B-side or non-show surface 118 of the first composite laminate 114 of the composite sewn part 102. In addition, each first stringer portion 120 and each second stringer portion 122 have a vertical portion or web 126 that extends upwardly from the flange portion 124. The vertical portion or web 126 is integrally formed with the flange portion 124 such that stringer the first and second stringer portions 120 and 122 are formed as a single unitary structure.

The first composite laminate or skin laminate 114 and the first stringer portion 120 and the second stringer portion 122 are in one non-limiting embodiment formed from Non-Crimp Fabrics (NCF) which consist of or comprise or include unidirectional laminate plies (carbon fiber) which are kept together by stitching yarns arranged in a number of different orientations relative to the fabric production direction. The stitching yarn holds the plies together for handling but contribute little to the mechanical performance of the overall laminate construction. Once the first composite laminate or skin laminate 114 and the first stringer portion 120 and the second stringer portion 122 are stitched together, they are resin infused to create the final, cured composite. The first composite laminate or skin laminate 114 and the first stringer portion 120 and the second stringer portion 122 may also be automated tape placement (ATP) and automated fabric placement (AFP) composites.

Improvements to Current State-of-the-Art (Process/Composite Laminate Construction)

Stabilization of the stringer 112 during fixturing and subsequent stitching to the skin layer or first composite laminate or skin laminate 114 of the composite sewn part 102 is improved via the use of a polymer reinforcement 128 (see at least FIGS. 12C-12G). It being understood that the materials and composition and layers of the first stringer portion 120 and the second stringer portion 122 are the same as the skin layer or first composite laminate or skin laminate 114. Alternatively, the materials and composition and layers of the first stringer portion 120 and the second stringer portion 122 are different from the skin layer or first composite laminate or skin laminate 114. The stringer 112 including the first stringer portion 120, the second stringer portion 122 and the skin layer or first composite laminate or skin laminate 114 can consist of, but is not limited to, multiple layers of non-crimped carbon fiber multiaxial laminate. The polymer reinforcement 128 can consist of, but is not limited to, a thermoplastic profile extrusion. In other words, the polymer reinforcement 128 is formed by an extrusion process. The polymer reinforcement 128 includes a horizontal portion 132 and an upwardly extending vertical portion 134 that extends from a portion or central portion of the horizontal portion 132 such that the polymer reinforcement 128 has a "T" shape or inverted "T" shape depending on the part orientation.

After a stringer laminate 130 (illustrated in FIG. 12A) is separated in half into the first stringer portion 120 and the second stringer portion 122 (FIG. 12B), each half or the first stringer portion 120 and the second stringer portion 122 containing an equal amount of laminate layers.

In FIG. 12C, the reinforcement 128 is placed between the two halves (the first stringer portion 120 and the second stringer portion 122) of the stringer 112 (FIG. 12D) and the stringer halves (the first stringer portion 120 and the second stringer portion 122) are folded to comply with the shape of the reinforcement 128. As such, each first stringer portion 120 and each second stringer portion 122 have a flange portion 124 and a vertical portion or web 126 that extends upwardly from the flange portion 124. The vertical portion or web 126 is integrally formed with the flange portion 124 such that stringer the first and second stringer portions 120 and 122 are formed as a single unitary structure.

In FIG. 12E, double sided stitching (lines 138) of the vertical portion or web 126 of the laminate of the first stringer portion 120 and the second stringer portion 122 is used to secure the vertical portion or web 126 of the stringer halves (first stringer portion 120 and the second stringer portion 122) to the reinforcement 128 to provide a reinforced stringer assembly 136.

In FIG. 12F, the reinforced stringer assembly 136 is then placed onto the B-side or non-show surface 118 of the first composite laminate or skin laminate 114 and is secured thereto with single-sided stitching (lines 140) through each flange portion 124 of the laminate of the first stringer portion 120 and the second stringer portion 122 (See at least FIG. 12G). Placement of the reinforced stringer assembly 136 can occur with the webs 126 of the stringer 112 facing either the + or −z directions as illustrated in the FIGS. 10A to 11B. Utilization of a polymer reinforcement 128 eliminates the need to use a veil to prevent displacement of the stringer 112 and the first composite laminate or skin laminate or skin 114 construction into a tooling pocket when stitching from the A-side 116 of the skin material 114, with the stringer webs 126 facing the −z direction (see at least FIG. 13). The polymer reinforcement 128 stabilizes and aids in alignment of the stringer 112 when stitching the stringer 112 to the skin material 114 from the B-side 118 of the skin material 114, with the stringer web facing the +z direction for example the orientations in FIGS. 11A, 11B and (FIG. 12G). Note: the reinforcement 128 is not illustrated in FIGS. 11A and 11B.

Figure 13:
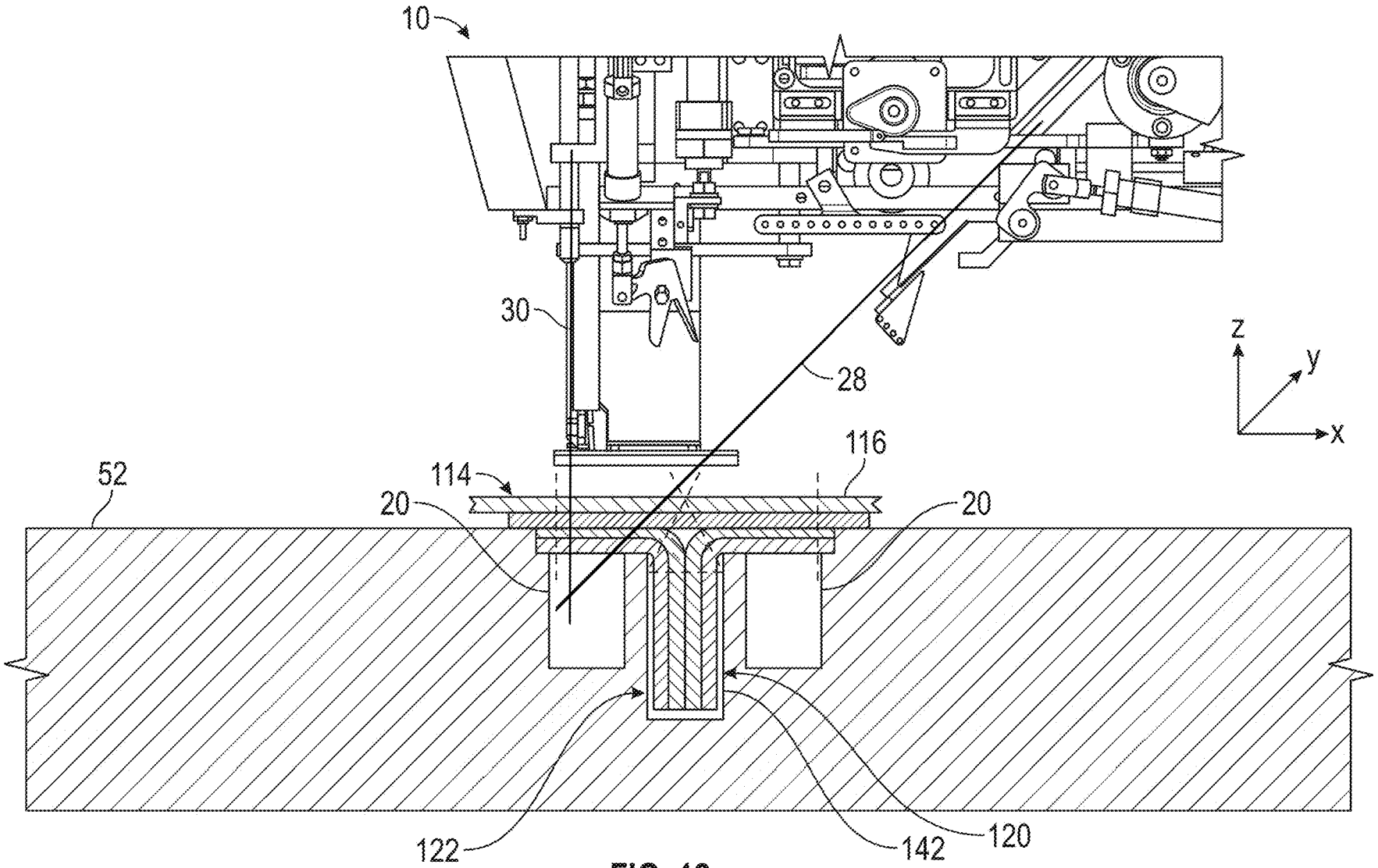
FIG. 13 is a view of a composite sewing head sewing composite laminates together on an A-side or show side of a product with a sewing fixture in accordance with the present disclosure.

FIG. 13 is a view of a composite sewing head 10 sewing the composite laminates together on the A-side or show side 116 of the composite sewn part 102 with a sewing fixture 52 with channels or pockets 20 for the needles 28, 30 as well as a pocket, cavity or channel 142 in the tooling or fixture 52 for the webs 126 of the stringer 112 in accordance with the present disclosure. As mentioned above, the polymer reinforcement 128 provides support and eliminates the need to use a veil to prevent displacement of the stringer 112 and the first composite laminate or skin laminate or skin 114 construction into the tooling pocket when stitching from the A-side 116 of the skin material 114, with the stringer webs 126 facing the −z direction during the stitching process. As illustrated and in one non-limiting embodiment, one of the threads is fed through composite laminate using a needle angled 45 degrees (feed needle) to the composite laminate surface.

FIGS. 14A-14D illustrate a laminate constriction process or method in accordance with the present disclosure. FIG. 14A illustrates a first step of providing two separate Non-Crimp Fabric (NCF) composite laminate sheets 120, 122. In a second step (FIG. 14B), the two separate Non-Crimp Fabric (NCF) composite laminate sheets 120, 122 are folded to create two halves of the stringer 118.

In a third step (FIG. 14C) the folded separate Non-Crimp Fabric (NCF) composite laminate sheets 120, 122 are positioned on each side of the polymer reinforcement 128 to form a stringer assembly. The assembly is then fed through a stationary manual sewing machine 144 or the sewing machine 144 can be attached to a robot and automatically fed along the length of the stationary stringer assembly. Once stitched to the folded separate Non-Crimp Fabric (NCF) composite laminate sheets 120, 122 are stitched to the polymer reinforcement 128 a reinforced stringer assembly 136.

In step 4 (FIG. 14D), the Non-Crimp Fabric (NCF) multilaminate composite skin 114 is placed on top of the reinforced stringer assembly 136 and robotically stitched through each flange of the reinforced stringer assembly 136. Thereafter, the multilaminate composite skin 114 and the reinforced stringer assembly 136 is resin infused to create a final, cured composite. As previously mentioned, the multilaminate composite skin 114 may be secured by stitching through the A-side or show side 104 of the multilaminate composite skin 114 of the composite sewn part 102 or alternatively the B-side or non-show side 106 of the multilaminate composite skin 114 of the composite sewn part 102. In yet another alternative, the multilaminate composite skin 114 may be secured by stitching through both the A-side or show side 104 of the multilaminate composite skin 114 and the B-side or non-show side 106 of the multilaminate composite skin 114 of the composite sewn part 102.

Figure 15D:
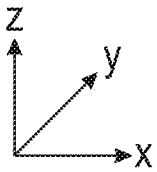
FIGS. 15B-15D illustrate laminate constriction processes in accordance with alternative embodiments of the present disclosure.
Figure 15D:
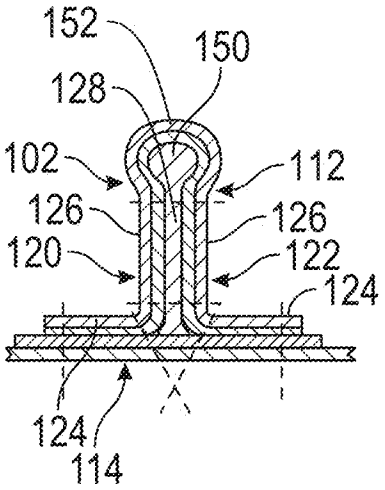
Figure 15C:
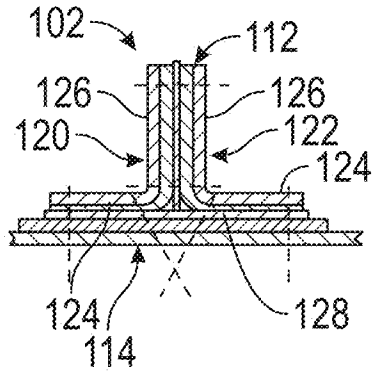
Figure 15B:
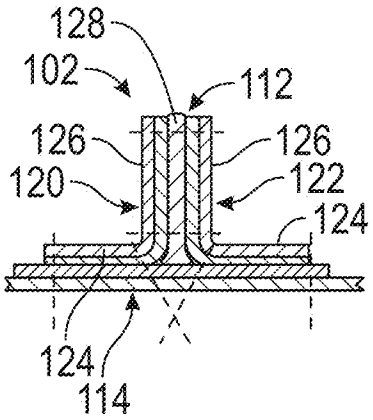
Figure 15A:
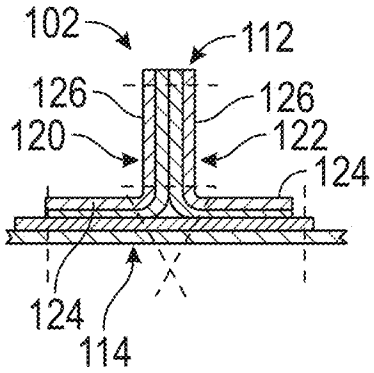
FIG. 15A illustrates a laminate construction with no reinforcement.

FIG. 15A illustrates a laminate construction with no reinforcement 128. FIGS. 15B-15D illustrate a laminate construction processes in accordance with alternative embodiments of the present disclosure. In FIG. 15B, the polymer reinforcement 128 is only located between the stringer webs 126 of the first stringer portion 120 and the second stringer portion 122 separating the stringer webs 126 of the first stringer portion 120 and the second stringer portion 122 and adding a polymer reinforcement 128 along the y-z plane with reference to the axes shown in the FIGS. In FIG. 15C, the polymer reinforcement 128 is only located between the flange portions 124 of the first stringer portion 120 and the second stringer portion 122 and the B-side or non-show surface of the multilaminate composite skin 114 along the x-y plane with reference to the axes shown in the FIGS. In FIG. 15D, the polymer reinforcement 128 is similar to the configuration illustrated in FIGS. 12C and 12D-12G however, the polymer reinforcement 128 and provides reinforcement along the x-y, y-z or x-y and y-z planes with reference to the axes shown in the FIGS. and includes a polymer reinforcing rod 150 at an end of the vertical portion or web 134 of the polymer reinforcement 128. In this embodiment, the first stringer portion 120 and the second stringer portion 122 are replaced with a single stringer portion 152 which extends over the polymer reinforcing rod 150. Here the single stringer portion 152 includes both flange portions 124 and the stringer webs 126. In one embodiment, the polymer reinforcing rod 150 is separately applied to the polymer reinforcement 128 or alternatively integrally formed with the polymer reinforcement 128 when it is forced with an extruding process.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A composite sewn part for use in a subsequent curing process, comprising:

a first composite laminate;

at least one stringer secured to the first composite laminate by stitches, the at least one stringer including a first stringer portion comprising a composite laminate and a second stringer portion comprising a composite laminate, which are sewn together to provide the at least one stringer, the first stringer portion having a flange portion that is sewn to the first composite laminate and a web that extends upwardly from the flange portion and the second stringer portion having a flange portion that is sewn to the first composite laminate and a web that extends upwardly from the flange portion of the second stringer portion; and a polymer reinforcement located between the first stringer portion and the second stringer portion or between the first composite laminate and the first stringer portion and the second stringer portion;

wherein the polymer reinforcement includes a horizontal portion located between the flange portion of the first stringer portion and the flange portion of the second stringer portion and the polymer reinforcement includes an upwardly extending vertical portion that extends from a portion of the horizontal portion, the upwardly extending vertical portion being located between the web of the first stringer portion and the web of the second stringer portion and the polymer reinforcement includes a polymer reinforcing rod at an end of the upwardly extending vertical portion of the polymer reinforcement.

2. The composite sewn part as in claim 1, wherein the flange portion and the web of the first stringer portion are integrally formed with each other to provide a single unitary structure and wherein the flange portion and the web of the second stringer portion are integrally formed with each other to provide a single unitary structure.

3. The composite sewn part as in claim 2, wherein the first composite laminate, the first stringer portion and the second stringer portion are formed from Non-Crimp Fabrics (NCF) which consist of unidirectional laminate plies.

4. The composite sewn part as in claim 1, wherein the first composite laminate, the first stringer portion and the second stringer portion are formed from Non-Crimp Fabrics (NCF) which include unidirectional laminate plies.

5. The composite sewn part as in claim 1, wherein materials and composition and layers of the first stringer portion and the second stringer portion are the same as the first composite laminate.

6. The composite sewn part as in claim 1, wherein materials and composition and layers of the first stringer portion and the second stringer portion are the same but different from the first composite laminate.

7. The composite sewn part as in claim 1, wherein the polymer reinforcement is formed by an extrusion process.

8. The composite sewn part as in claim 1, wherein the polymer reinforcement includes a horizontal portion and an upwardly extending vertical portion that extends from a portion of the horizontal portion.

9. The composite sewn part as in claim 1, wherein the first stringer portion and the second stringer portion contain an equal amount of laminate layers.

10. The composite sewn part as in claim 1, wherein the polymer reinforcement includes a horizontal portion located between the flange portion of the first stringer portion and the flange portion of the second stringer portion and the polymer reinforcement includes an upwardly extending vertical portion that extends from a portion of the horizontal portion, the upwardly extending vertical portion being located between the web of the first stringer portion and the web of the second stringer portion.

11. The composite sewn part as in claim 1, wherein the polymer reinforcement is only located between the first stringer portion and the second stringer portion.

12. The composite sewn part as in claim 1, wherein the polymer reinforcement is only located between first composite laminate and the first stringer portion and the second stringer portion.

13. The composite sewn part as in claim 1, wherein the polymer reinforcement is located between the first stringer portion and the second stringer portion and the polymer reinforcement is located between first composite laminate and the first stringer portion and the second stringer portion.

14. The composite sewn part as in claim 1, wherein the first stringer portion and the second stringer portion are part of a single stringer portion which extends over the polymer reinforcing rod.

15. The composite sewn part as in claim 14, wherein the polymer reinforcement is formed by an extrusion process.

16. A method for providing a composite sewn part for use in a subsequent curing process, comprising:

locating a polymer reinforcement between a first stringer portion comprising a composite laminate and a second stringer portion comprising a composite laminate or locating a polymer reinforcement between a first composite laminate and a first stringer portion and a second stringer portion;

stitching the first stringer portion to the second stringer portion to provide at least one stringer;

stitching the first stringer portion to the first composite laminate;

stitching the second stringer portion to the first composite laminate; and wherein during the at least one of the stitching steps the stitches pass through the polymer reinforcement;

wherein the first stringer portion has a flange portion that is sewn to the first composite laminate and a web that extends upwardly from the flange portion and the second stringer portion having a flange portion that is sewn to the first composite laminate and a web that extends upwardly from the flange portion of the second stringer portion, and the web of the first stringer portion is sewn to the web of the second stringer portion; and wherein the polymer reinforcement includes a horizontal portion located between the flange portion of the first stringer portion and the flange portion of the second stringer portion and the polymer reinforcement includes an upwardly extending vertical portion that extends from a portion of the horizontal portion, the upwardly extending vertical portion being located between the web of the first stringer portion and the web of the second stringer portion and the polymer reinforcement includes a polymer reinforcing rod at an end of the upwardly extending vertical portion of the polymer reinforcement.

17. The method in claim 16, wherein the flange portion and the web of the first stringer portion are integrally formed with each other to provide a single unitary structure and wherein the flange portion and the web of the second stringer portion are integrally formed with each other to provide a single unitary structure.

18. The method as in claim 16, wherein the first composite laminate, the first stringer portion and the second stringer portion are formed from Non-Crimp Fabrics (NCF) which consist of unidirectional laminate plies.

* * * * *